US006928732B2

(12) United States Patent
Sakai et al.

(10) Patent No.: US 6,928,732 B2
(45) Date of Patent: Aug. 16, 2005

(54) METHOD OF MANUFACTURING PIPING HAVING JOINING PORTION

(75) Inventors: Koji Sakai, Kariya (JP); Makoto Ito, Kariya (JP); Shinji Kato, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/623,768

(22) Filed: Jul. 21, 2003

(65) Prior Publication Data

US 2004/0045151 A1 Mar. 11, 2004

(30) Foreign Application Priority Data

Jul. 22, 2002 (JP) ..... 2002-213000
May 30, 2003 (JP) ..... 2003-155230

(51) Int. Cl.[7] ..... B23P 17/00

(52) U.S. Cl. ..... 29/890.144; 29/890.14; 29/509; 29/523

(58) Field of Search ..... 29/890.14, 890.145, 29/890.141, 890.144, 509, 523; 72/370.03, 370.1; 285/334.5

(56) References Cited

U.S. PATENT DOCUMENTS 4,980,961 A * 1/1991 Caudill ..... 29/509
5,090,611 A * 2/1992 Takikawa et al. ..... 228/173.4
6,327,771 B1 * 12/2001 Anglin et al. ..... 29/523

FOREIGN PATENT DOCUMENTS

| | | |
|---|---|---|
| DE | 199 56 463 | 5/2000 |
| EP | 0 791 776 | 8/1997 |
| FR | 2 258 232 | 8/1975 |
| JP | 7-269987 | 10/1995 |
| JP | 2000-343170 | 12/2000 |

OTHER PUBLICATIONS

French Search Report dated Dec. 18, 2003 in corresponding French Application No. FR 0308874.

* cited by examiner

*Primary Examiner*—Marc Jimenez
(74) *Attorney, Agent, or Firm*—Harness, Dickey & Pierce, PLC

(57) ABSTRACT

An arbitrary position of a pipe is clamped and a connector is engaged with the pipe. Then, an end portion of the pipe is expanded with a tool such as a diameter expanding punch so as to caulk the pipe to the connector from inside. As a pipe fluctuation-absorbing portion, which is a relief space of pipe material, is provided in a portion of an inner face of the connector, when the diameter-expanding portion is formed, an excess pipe material is absorbed there and the length of the pipe is reduced and adjusted to an appropriate value. A portion in which the pipe fluctuation-absorbing portion is formed is not limited to a forward end portion of the pipe but it may be formed on an inner face of the connector corresponding to an intermediate portion.

8 Claims, 14 Drawing Sheets

METHOD OF MANUFACTURING PIPING HAVING JOINING PORTION

BACKGROUND OF THE INVENTION

1. Field of the Invention

The present invention relates to piping having a joining portion and used, for example, for a portion of a refrigeration cycle of an air-conditioning system for vehicle use. More particularly, the present invention relates to a method of manufacturing piping by means of plastic working. The present invention also relates to a method of adjusting the length of piping which is automatically conducted in the method of manufacturing it.

2. Explanation of the Related Art

Concerning the refrigerant pipes to connect various components with each other in a refrigeration cycle of an air-conditioning system used for a vehicle and concerning, for example, the refrigerant pipes, one is an outlet pipe and the other is an inlet pipe, to connect a refrigerant compressor, a condenser and a receiver, which are provided in an engine compartment, with an evaporator provided in a passenger compartment. The two refrigerant pipes are arranged together in parallel with each other in the front and at the rear of an expansion valve which is arranged so that the end portions of the two refrigerant pipes can be inserted into the expansion valve. In this case, it is unnecessary for a low pressure pipe, which guides a refrigerant from the evaporator to the compressor, so that the refrigerant can be returned, without passing through the expansion valve. However, in order to handle the two pipes easily, one being an outlet pipe and the other being a returning, both end portions of the two pipes located in the front and at the rear of the expansion valve are brazed to the same connector. In this way, the two pipes and the two connectors are connected and integrated with each other into one body by joining portions. Pipes having the joining portions, which are formed by being integrated with the pipes, are used in many cases.

In the case where these pipes are manufactured, even when one end portion of each of the two pipes is brazed to the connector, unless the other end portion of each of the two pipes is accurately machined so that it can be fitted at a predetermined position, it is impossible to positively connect both end portions of the two pipes with the two connectors. However, it is common that the refrigerant pipes provided in the refrigeration cycle of the air-conditioning system for vehicle use are bent into a complicated profile. Therefore, it is very difficult for the other end portions of the two bent pipes, which have already been cut and bent, to be accurately adjusted to the respective predetermined positions in the other connectors. Accordingly, before the pipes are brazed to the connector, it is necessary to previously repair the individual pipes so as to adjust the bending state and the profiles of the end portions of the pipes, that is, it is necessary to enhance the accuracy of the individual pipes which are used as parts of the air-conditioning system. Of course, this repair work causes an increase in the manufacturing cost of the pipe having the joining portion.

The above problems are not limited to the pipes having the joining portions used for the refrigerating cycle into which the two pipes and two connectors are incorporated. The above problems are caused even in the case of manufacturing a bent pipe, both end portions of which are brazed to two connectors, which must be respectively attached at a predetermined position in a predetermined posture. In the case where both end portions of a large number of bent pipes, the number of which is not less than three, are brazed to the same connector so as to manufacture a single pipe, the end portions of all pipes must be aligned in the same connector. Therefore, it is necessary to enhance the accuracy of the pipes, which are parts, which increases the manufacturing cost of the pipe having the joining portion. When the pipe and the connector are joined to each other by means of brazing, the joining strength can be positively enhanced. On the other hand, it is necessary to check for leakage of a fluid, which increases the manufacturing cost.

In this connection, although the detailed explanations will be made later, in a portion of the embodiment of the present invention, there is provided a pipe in which buckling is caused as a method for reducing the length of the pipe. The first prior art, which is approximately similar to this method, is disclosed in Japanese Unexamined Patent Publication No. 2000-343170 as a method of forging a pipe. According to the first prior art, when a force is given to an end face of a pipe, an excess metal in the middle portion of the pipe in the longitudinal direction is pushed to a relief space formed in a metallic die to support a cylindrical side of the pipe, so that the length of the pipe can be reduced by a quantity of the excess metal pushed to the side.

However, the first prior art is a technique capable of being applied to a straight pipe, the length of which is several times as long as the diameter of the pipe. Therefore, it is impossible to apply this technique to a refrigerant pipe, which is a main object of the present invention, the length of which is long and the profile of which has a plurality of bent portions.

As the second prior art, the Japanese Examined Patent Publication No. 3281997 discloses a connector used for connecting pipes, the appearance of which is partially similar to the pipe having a joining portion of the present invention. However, according to the second prior art, it is an object to form a fluid passage in a solid block used for connection, the profile of which is predetermined, and a pipe is inserted into a hole of this solid block used for connection. When the block for connection is held between a seat portion of a large diameter, which is previously formed in the pipe, and an expanded diameter portion which is formed in an end of the pipe, the pipe is integrated with the inside of the block.

According to the second prior art, the length of the pipe between the large diameter seat portion and the expanded diameter portion is always the same as the length of the hole of the block for connection, that is, there is no possibility that the length of the pipe between the large diameter seat portion and the expanded diameter portion is different from the length of the hole of the block for connection. Therefore, the second prior art includes no intention that the length of a pipe, the length of which inevitably fluctuates because a bent portion is formed in the pipe, is adjusted to an arbitrary value. Accordingly, although the appearance of the second prior art is partially similar to that of the present invention, the second prior art is essentially different from the art of the present invention. Therefore, it is impossible for the second prior art to adjust the length of the pipe to an arbitrary value when an extended diameter portion is machined at the end portion of the pipe.

SUMMARY OF THE INVENTION

The present invention has been accomplished to solve the above problems of the prior art. It is a primary object of the present invention to provide a method of manufacturing piping by which the length of the pipe can be easily adjusted to an arbitrary length when the pipe length is simultaneously automatically adjusted in a diameter expanding process in which an expanded diameter portion is formed at an end portion of the pipe by a simple means having no possibility of increasing the manufacturing cost when it is compared with the repairing work conducted by machining the pipe which is a part composing piping having a joining portion. It is also an object of the present invention to provide a method of manufacturing piping having a joining portion capable of greatly reducing the manufacturing cost compared with the prior art when an end portion of the pipe and a connector are connected with each other by means of mechanical caulking, without conducting a brazing work adopted in the prior art, so that a sufficiently high connecting strength and sealing performance can be provided.

In order to solve the above problems, the present invention provides a method of manufacturing piping having a joining portion in which a diameter expanding portion is formed at an end portion of a pipe, comprising the steps of: fixing the pipe by clamping an appropriate portion of the pipe with a pipe chuck for adjusting the pipe length simultaneously when the expanding diameter portion is formed; engaging a connector having a through-hole, the inner diameter of which is expanded, with an end portion of the pipe; and caulking an end portion of the pipe with a diameter expanding tool so as to expand the diameter of the pipe end portion and caulk it to an inner face of the connector wherein, as a pipe fluctuation absorbing portion, which is a relief space of the pipe material, is previously formed in a portion on the inner face of the connector, when a plastic deformation is given to the pipe end portion by the diameter expanding tool so as to form a diameter expanding portion, an excess pipe material is absorbed by the pipe fluctuation absorbing portion and the pipe length is reduced and automatically adjusted to a predetermined length.

The method of manufacturing piping having a joining portion of the present invention includes: a step in which an appropriate portion of the pipe is clamped with a pipe chuck so as to fix the pipe; a step in which a connector having a through-hole, the inner face profile of which is expanded, or a female-type jig replacing the connector is engaged with an end portion of the pipe and a step in which the end portion of the pipe is caulked onto the inner face of the connector by expanding the end portion of the pipe with a diameter expanding tool. The characteristic of the method of manufacturing a piping having a joining portion of the present invention is that the pipe fluctuation-absorbing portion, which is a relief space of the pipe material, is previously formed in a portion on the inner face of the connector or the female type jig replacing it. Accordingly, when a plastic deformation is given to the pipe end portion with the diameter expanding tool so as to form the diameter-expanding portion, an excess pipe material is absorbed by the pipe fluctuation absorbing portion and the pipe length is reduced. Therefore, the pipe length can be automatically adjusted to an objective length.

The present invention provides a method of manufacturing a piping having a joining portion, further comprising the step of: reducing the length of the pipe by forming an annular protruding portion on an outer circumference of the pipe when a portion of the pipe material is pushed out into the relief space previously formed on the end face of the pipe chuck by buckling the pipe when one of the pipe end portions is given a force by a punch used for sizing, after the step of fixing the pipe by clamping an appropriate portion of the pipe by the pipe chuck. In this case, the length of the pipe can be independently adjusted by a plurality of means. Therefore, the degree of freedom of adjustment can be enhanced and, further, the width of adjustment can be extended. In the case of forming the protruding portion, a quantity of reduction of the pipe length can be increased by increasing the radius of the protruding portion. Accordingly, the radius of the protruding portion may be made to be variable while the height of the relief space formed on the end face of the pipe chuck is being maintained constant.

In a method of manufacturing piping having a joining portion according to the present invention, after an end portion of the pipe on the side opposite to the side on which the diameter expanding portion is formed has been fixed at a predetermined position by a jig, when an appropriate portion of the pipe is clamped and fixed by the pipe chuck, the length of the pipe is adjusted on the basis of an end face of the pipe chuck.

The pipe fluctuation absorbing portion formed on an inner face of the through-hole to be expanded of the connector or the female type jig replacing the connector is formed in a gap between the inner face of the through-hole and the surface of the tool used for expanding the diameter. This pipe fluctuation-absorbing portion may be formed corresponding to a forward end portion of the pipe located inside the connector. Alternatively, this pipe fluctuation-absorbing portion may be formed corresponding to a middle portion of the pipe located inside the connector.

The following method of manufacturing piping having a joining portion of the present invention may be provided as a specific example described as follows. A diameter-expanding portion is formed at one end portion of a pipe, and the pipe is caulked inside a connector having a through-hole to be expanded. On the other hand, the other end portion of the pipe may be simply caulked to a connector.

In the case of executing the method of manufacturing a piping having a joining portion of the present invention, it is preferable that a sleeve is provided on the outer circumference of the tool used for expanding the diameter and the connector is held before and after the machining of the diameter expanding portion when the sleeve is moved separately from the tool used for expanding the diameter. When a forward end portion of the expanded pipe is crushed down by a portion of the end face of the sleeve, a portion of the material can be made to flow into the pipe fluctuation absorbing portion so as to adjust the length of the pipe.

The method of manufacturing piping having a joining portion of the present invention can be applied to not only a single pipe but also a plurality of pipes. Due to the foregoing, for example, the length of the plurality of pipes can be adjusted to be the same, that is, a relation between the lengths of the plurality of pipes can be adjusted. In this case, at least end portions of the plurality of pipes on one end side can be connected with the common connector.

DESCRIPTION OF THE PREFERRED EMBODIMENTS

Figure 3:
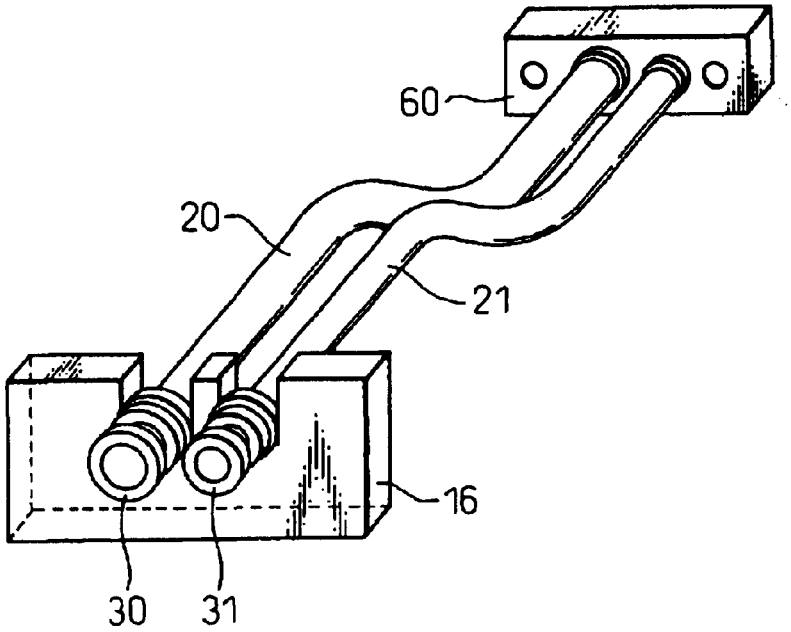
FIG. 3 is a perspective view exemplarily showing a pipe having a joining portion as a product.

Next, by referring to the accompanying drawings, detailed explanations will be made into several preferred embodiments of piping having a joint potion of the present invention. Any one of the embodiments shown in the drawings of the present invention relates to a method of manufacturing a piping attached to the front and the rear portion of an expansion valve in a refrigeration cycle of an air-conditioning system for vehicle use not shown in the drawings. As the appearance of a specific example is shown in FIG. 3, a piping manufactured by the method of the embodiment shown in the drawings is a part used for piping and includes: a plurality of pipes such as two pipes 20, 21, one being a large diameter pipe and the other being a small diameter pipe, which are bent into a predetermined profile; and two connectors 16, 60 composed of thick metal plates which are integrated with both end portions of the pipes by means of caulking.

Figure 1:
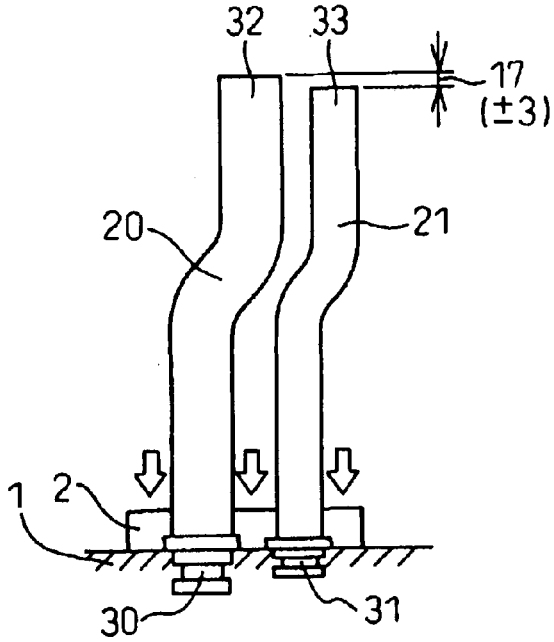
FIG. 1 is a front view showing two pipes, which are machined in the first step, and a connector of one end portion of the first embodiment of the method of manufacturing a piping having a joining portion of the present invention.
Figure 2:
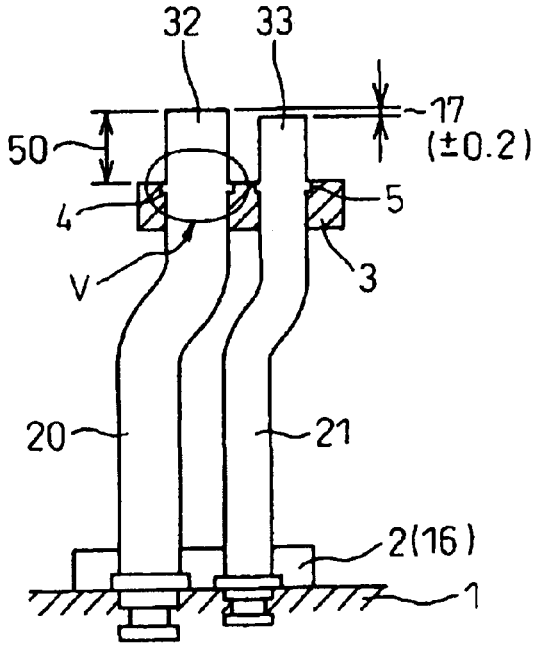
FIG. 2 is a front view showing a state in which a pipe is subjected to sizing in the longitudinal direction in the first step of the first embodiment.

In the preceding step, the pipes 20, 21 are manufactured by means of extrusion molding from molten aluminum into a continuous cylindrical pipe material. The long pipe material, which is wound like a coil, is straightened into a straight pipe by a straightening roller and then cut into a predetermined length by a cutter. Then, as shown in FIGS. 1 and 2, one end portion 30 or 31 is subjected to bulging which is one type of press forming. Further, the portion of the pipe is subjected to spinning which is one type of rolling so as to form a groove used for an O-ring seal. After that, the pipes 20, 21 are bent to a target profile with a pipe bender.

The connector 16 caulked to one end portions of the two pipes 20, 21, the diameters of which are different from each other, that is, the connector 16 caulked to the lower end portion in FIG. 1 is formed into an E-shape, the plane shape of which has two semicircular recess portions for receiving the two pipes 20, 21 to be caulked to the recess portions. The connector 60 of the other end portion, that is, the connector 60 in the upper end portion in FIG. 1 is formed into a shape of a pair of eye-glasses having two circular holes into which the pipes 20, 21 are inserted and then caulked. In this connection, caulking of the connector 16 to the pipes 20, 21 is conducted in the final step. This piping is attached as follows. The connector 16 on one end side is attached to the expansion valve in the refrigeration cycle by means of bolts, and the connector 60 on the other end side is attached to the evaporator in the passenger compartment or the receiver in the engine compartment by the same means.

In this case, the small diameter pipe 21, which is one of the two pipes, is used to guide a refrigerant on the high-pressure side in the refrigeration cycle from the receiver to the expansion valve or from the expansion valve to the evaporator. When the connector 16 arranged on one end side, the profile of which is substantially the same as that of the temporary pipe fixing jig 2 shown in FIG. 1 so that the connector 16 can be replaced with the temporary pipe fixing jig 2, is attached to the expansion valve, not shown, which can be replaced with temporary pipe set jig 1, the small diameter pipe 21 is communicated with the inside of the expansion valve as it is. On the other hand, the large diameter pipe 20 is a pipe used to guide a returning refrigerant of low pressure from the evaporator, which is arranged in the passenger's room, into the refrigerant compressor that is arranged in the engine compartment. The large diameter pipe 20 is mechanically connected with the expansion valve by the connector 16 on one end side, however, the large diameter pipe 20 is not directly communicated with the inside of the expansion valve. Therefore, the large diameter pipe 20 is communicated with the bypass passage, not shown, which is arranged in parallel with the expansion valve in such a manner that the large diameter pipe 20 goes round the expansion valve.

FIGS. 1 to 5 are views showing the first step of the first embodiment of the method of manufacturing a piping having a joining portion of the present invention. As described before, reference numeral 1 is a pipe set jig, which is used as one of the jigs in this method. Instead of the expansion valve, not shown, in the refrigeration cycle of the air-conditioning system for vehicle use, the pipe set jig 1 has two holes into which end portions 30, 32 of the two pipes 20, 21 are inserted. The end portions 30, 31 of the pipes are aligned by the pipe set jig and positioned at predetermined positions.

Reference numeral 2 is a temporary pipe-fixing jig. In the same manner as that of the connector 16 caulked to the end portions 30, 31 of the pipes in the third step of the first embodiment, the plane profile of the temporary pipe fixing jig 2 is formed into an E-shape for receiving the bulging portions of the pipes 20, 21. In the initial stage of this step, the temporary pipe-fixing jig 2 loosely engages portions of the pipes 20, 21, which are close to the end portions 30, 31 of the pipes 20, 21, with the two recess portions so as to support the pipes on one side. Due to the foregoing, the temporary pipe fixing jig 2 positions the end portions 30, 31 of the pipes in cooperation with the pipe set jig 1 and temporarily fixes a relative positional relationship of the bent portions of the respective pipes 20, 21.

As shown in FIG. 1, when the end portions 30, 31 of the pipes 20, 21 are fixed by the pipe set jig 1 and the temporary pipe fixing jig 2, a difference 17 in the size is generated between the other end portions 32, 33 of the pipe 20, 21. Since the individual pipes 20, 21 are manufactured by means of cutting and bending as described before, it is impossible to prevent the generation of this difference 17 in the size. In the case where one of the pipes 20, 21 has an appropriate size in the longitudinal direction and an allowable range of the difference in the size of the other pipe with respect to this pipe is, for example, ±0.2 mm, when the difference 17 in the size, which is actually measured after the pipes 20, 21 have been attached, is, for example, ±3 mm which is large, in order to suppress this difference 17 in the size into the allowable range of ±0.2 mm so as to ensure the necessary accuracy of parts, the sizing work in the first step of the first embodiment is executed by using the pipe chuck 3 and others shown in FIG. 2.

Figure 4:
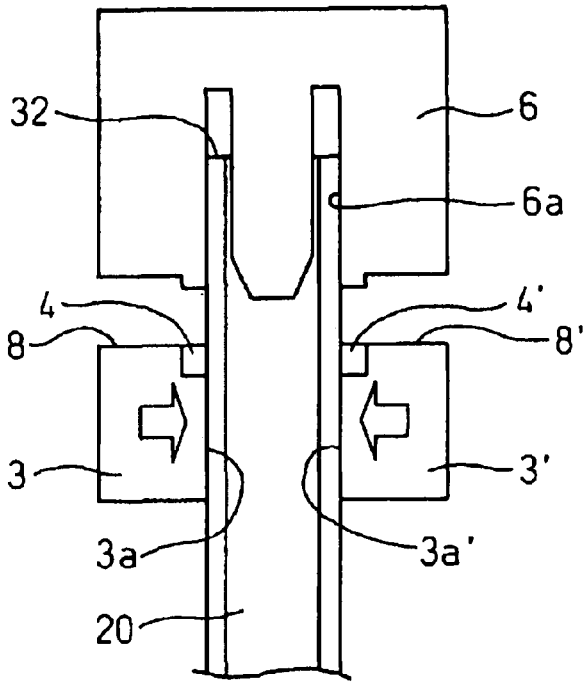
FIG. 4 is a sectional view showing a primary portion of the first step of the first embodiment.
Figure 5:
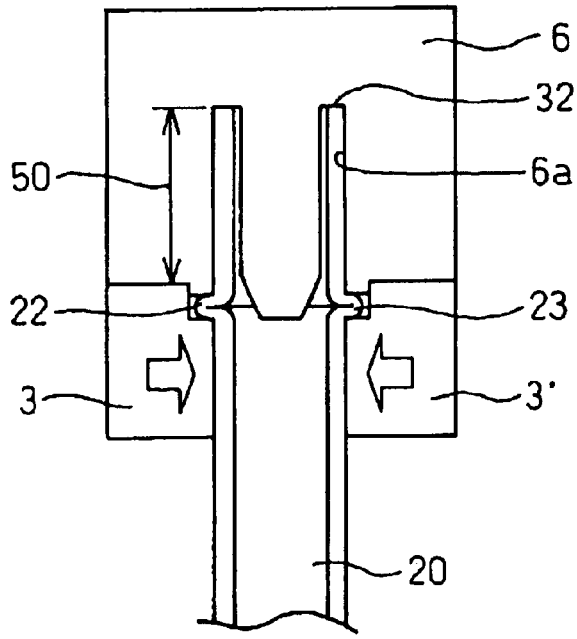
FIG. 5 is a sectional view showing a primary portion at the time successive to the time of the first step shown in FIG. 4.

The detail of the first step for sizing the difference 17 in the size in the longitudinal direction by the method of the first embodiment is shown in FIGS. 4 and 5. In this case, the length of the longer pipe 20 is reduced by means of sizing. In this connection, when the pipe 21 is too long and it is necessary to reduce the length of the pipe 21 or when the sizes of both pipes 20 and 21 are too long and it is necessary to reduce both of them, it is possible to conduct sizing on the pipe 21 in the same manner. However, in this case, explanations will be made only into a case in which the length of the pipe 20 in the longitudinal direction is reduced.

First of all, as shown in FIG. 4, a predetermined position close to the other end portion 32 of the pipe 20 is interposed and fixed between the split pipe chucks 3, 3' as shown by the arrows in the drawing. The pipe chucks 3, 3' are respectively provided with semicircular recess portions 3*a*, 3*a'* which are opposed to each other. It is possible for the pipe chucks 3, 3' to clamp the pipe 20 by these semicircular recess portions 3*a*, 3*a'*. When the semicircular recess portions 3*a*, 3*a'* are matched to each other, a circular opening is formed. The semicircular step portions 4, 4' are formed in the edge portions of the semicircular recess portions 3*a*, 3*a'* on the upper faces 8, 8' of the pipe chucks 3, 3' so that an annular relief space can be formed in an upper edge portion of the circular opening when the pipe 20 is received by the circular opening.

As shown in FIG. 4, after the pipe 20, the length of which is too long, has been clamped and fixed by the pair of pipe chucks 3, 3', the other end portion 32 of the pipe 20 is engaged with the punch 6 for sizing in which the recess portion 6*a* having a bottom portion of the same cylindrical shape as that of the pipe is formed, and the punch 6 for sizing is struck downward. Due to the foregoing, one portion of the pipe 20 is buckled, and one portion of the pipe material flows into the annular relief space composed of a pair of semicircular step portions 4, 4' formed on the upper faces 8, 8' of the chucks 3, 3'. In this way, the pipe buckling portions 22, 23, which are protruded in the lateral direction, are formed. These pipe buckling portions 22, 23 compose one continuous flange.

When the size of the pipe 20 in the longitudinal direction is reduced in this way, the difference 17 in the size in the longitudinal direction of the pipe 20 with respect to the pipe 21 can be reduced into the allowable range. The depth of the cylindrical recess portion 6*a* provided in the punch 6 used for sizing is shown by the reference numeral 50. The punch 6 used for sizing is lowered to a position where the punch 6 comes into contact with the upper faces 8, 8' of the pipe chucks 3, 3'. Therefore, since the depth 50 of the cylindrical recess portion 6*a* is constant, the length of the pipe after sizing can be made to be the same, irrespective of the length of the forward end portion of the pipe 20 clamped by the pipe chucks 3, 3'. Accordingly, when the pipe chucks 3, 3' are correctly positioned, the flange-shaped pipe buckling portions 22, 23 can be always formed at a position, the distance of which is constant from the other end portion 32 of the pipe 20. Further, the size of the pipe 20 in the longitudinal direction can be reduced to an appropriate value.

The first embodiment shows a case in which the piping is composed of the pipes 20, 21 and the connectors 16, 60. The reason why the above case is taken up in the first embodiment is described as follows. In order to make the explanation understood easily, the explanation is made on the assumption that the length of the pipe is a relative difference between the lengths of two pipes. However, of course, the necessary pipe length is the size 50 of the individual pipe. Therefore, the simplest piping to be manufactured by the manufacturing method of the present invention is composed of one bent pipe and two connectors caulked to both end portions of the bent pipe. In this case, it is unnecessary to adjust the lengths of a plurality of pipes. However, usually, it is necessary to cut and repair the pipe again, which has once cut, so that the length of the pipe can be an appropriate value. Instead of that, the pipe length can be adjusted to the appropriate value by the first step in the first embodiment described above.

Figure 6:
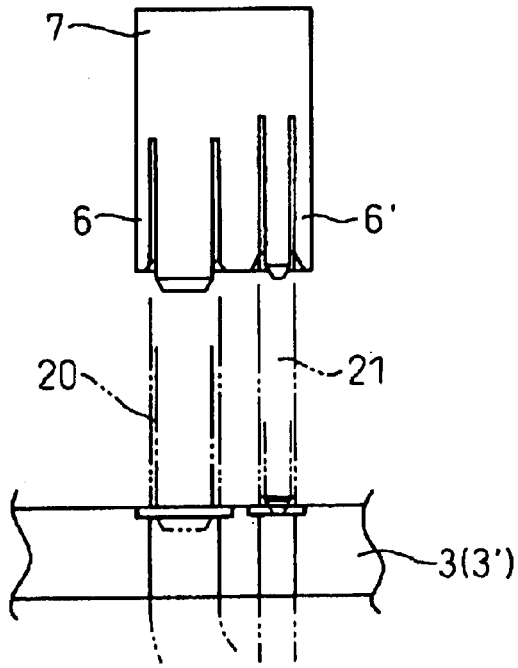
FIG. 6 is a conceptual view showing a punch for simultaneously machining two pipes.

In the above embodiment, explanations are made into a case in which the single punch 6 for sizing is used to conduct sizing on the pipe 20, 21 so that the length of the pipe 20, 21 can be adjusted one by one. However, in the case of simultaneously sizing a plurality of pipes, as shown in FIG. 6, as a variation of the punch 6 for sizing, the aggregated punch 7 for sizing, in which a plurality of punches 6, 6' for sizing are aggregated into one body, is used, and the first half (the first step) of the sizing step can be completed at a single stroke. In this case, a plurality of recess portions are provided in the pipe chucks 3, 3' so that a plurality of pipes 20, 21 can be simultaneously clamped. Other points are the same as those of the embodiment described before. Therefore, detailed explanations are omitted here.

Figure 7:
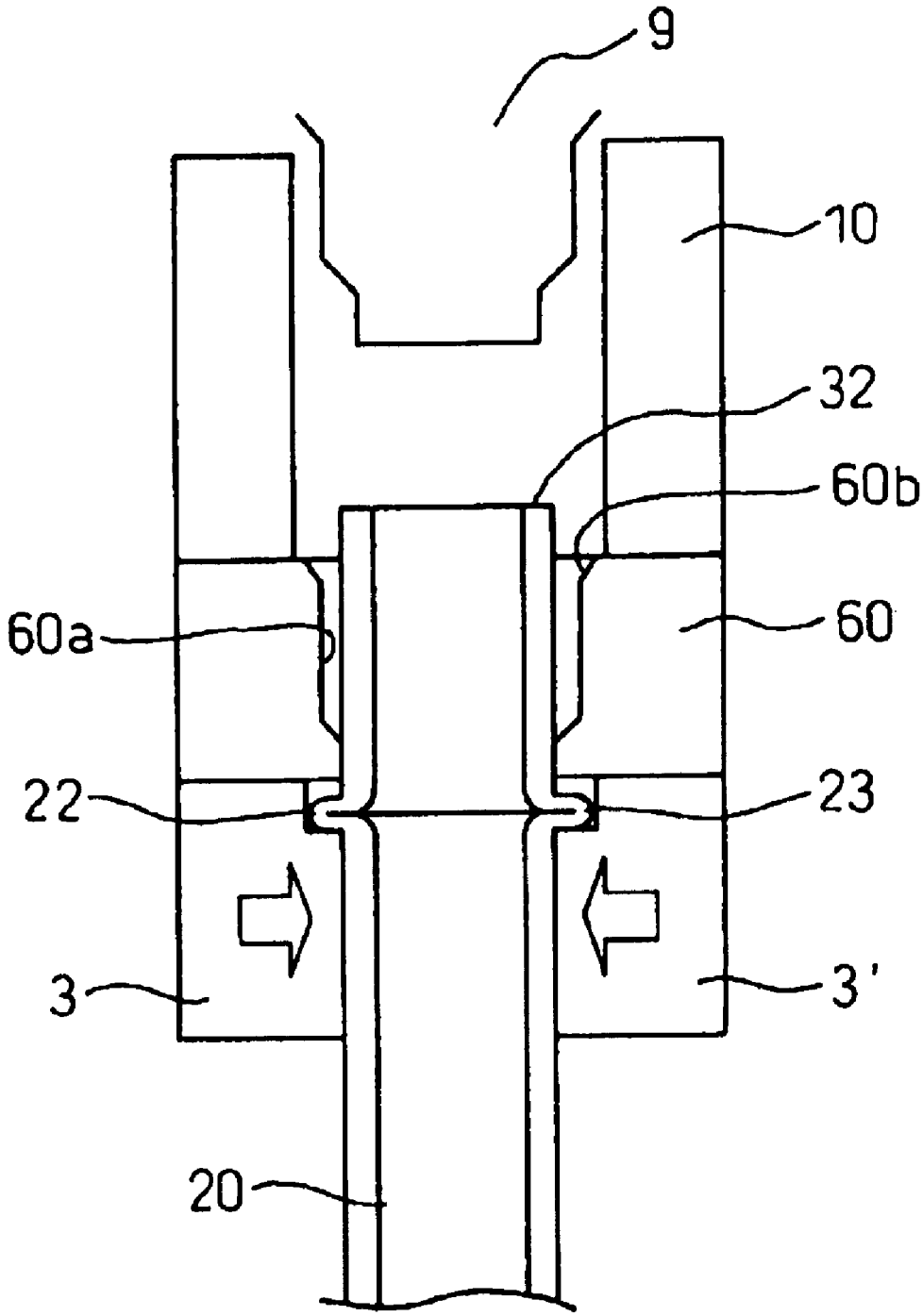
FIG. 7 is a sectional view showing a state before machining in the second step of the first embodiment.
Figure 8:
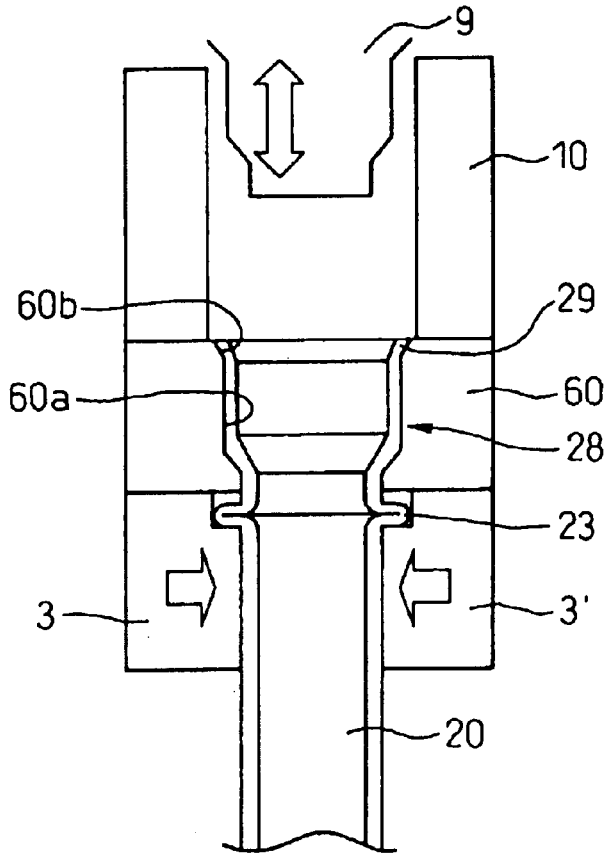
FIG. 8 is a sectional view showing a state after machining in the second step of the first embodiment.
Figure 9:
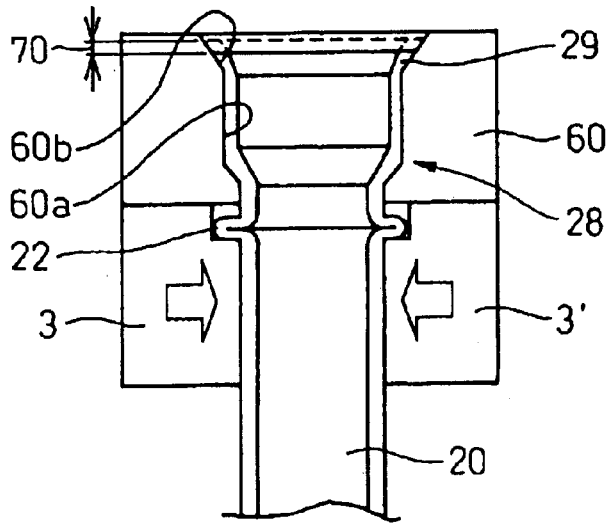
FIG. 9 is a sectional view showing a pipe fluctuation-absorbing portion in the second step of the first embodiment.

FIGS. 7 to 9 are views showing the second step provided in the first embodiment of the method of manufacturing a piping having a joining portion of the present invention. The second step is executed for simply and positively attaching the connector 60 to the other end portions 32, 33 of the pipes 20, 21 by means of caulking. In this step, the size of the piping in the longitudinal direction can be also adjusted. Therefore, in the case where a large difference 17 in the size is caused and the size cannot be easily adjusted in the first step and in the case where the size is adjusted only by the second step without relying on the first step, this function can be effectively utilized.

In this step, first of all, the connector 60 having the through-hole 60*a*, the diameter of which is extended upward, is engaged with the other end portion 32 of the pipe 20 clamped by the pipe chucks 3, 3'. As the pipe 20 is clamped by the pipe chucks 3, 3', the pipe 20 can be prevented from being shifted by a stroke of the punch 20 while the pipe 20 is being machined in the second step.

Next, the punch 9 for expanding the pipe diameter, the profile of which is shown in FIGS. 7 and 8, that is, the profile of which is substantially similar to the inner face profile of the through-hole 60*a* that is formed in the connector 60 and expanded upward and the profile of which is smaller than the inner face profile of the through-hole 60*a* by the size corresponding to the wall thickness, is inserted from above, and a stroke is given downward. Due to the foregoing, as shown in FIG. 8, the punch 9 for expanding the diameter expands the diameter of the pipe 20 in a portion close to the other end portion 32 and forms the expanded diameter portion 28. In this way, the other end portion 32 is tightly contacted with the inner face of the through-hole 60*a* of the connector 60, and the diameter of the other end portion 32 is further expanded. Due to the foregoing, the forward end portion 29 of the pipe, the diameter of which is expanded along the conical opening portion 60*b* formed in the through-hole 60*a*, is formed.

In this case, it is possible to change a profile of the other end portion 32 of the pipe 20 by only one stroke. However, since the punch 9 for expanding the diameter can be reciprocated in the vertical direction, it is possible to enhance the product accuracy when a small stroke is repeatedly given a plurality of times.

In the first embodiment, there is provided a cylindrical sleeve 10 which surrounds the circumference of the punch 9 for expanding the diameter and can be moved upward and downward differently from the punch 9 for expanding. This cylindrical sleeve 10 is lowered before the punch 9 for expanding the diameter conducts machining so that the connector 60 is held down. Even in the process of machining and even while the punch 9 for expanding the diameter is returning upward, the cylindrical sleeve 10 continues to hold the connector 60, so that the connector 60 cannot be moved by the motion of the punch 9 for expanding the diameter.

After the punch 9 for expanding the diameter has given a stroke, it returns upward. After that, the sleeve 10 also returns upward. Then, the pipe 20, which has been formed into a profile shown in FIG. 9, and the connector 60, which has been integrated with the pipe 20 being caulked, are left on the pipe chucks 3, 3'.

As described above, in the second step of the first embodiment, it is essential that the other end portion 32 of the pipe 20 is caulked to the connector 60 so that the other end portion 32 can be mechanically connected to the connector 60. As described above, the size of the forward end portion 29 of the pipe 20, the diameter of which is expanded when the pipe 20 is caulked along the conical opening portion 60*b* of the connector 60, especially the width in the longitudinal direction is changed according to the size of the other end portion 32 rather than the pipe buckling portions 22, 23 in the pipe 20 before the second step of the first embodiment is executed. As exaggeratedly shown in FIG. 9, the width of the conical opening portion 60*b* in the longitudinal direction is extended to as large as possible so that a small gap in the width can be left at the forward end portion 29 of the pipe, the diameter of which is expanded, and the lengths of portions provided ahead of the pipe buckling portions 22, 23 are made to be smaller than that. Due to the foregoing, the above gap becomes the pipe fluctuation-absorbing portion 70, the width of which is changed. This pipe fluctuation-absorbing portion 70 can be effectively used for adjusting the size of the pipe 20 in the longitudinal direction to an appropriate value. Accordingly, when the fluctuation of the size in the longitudinal direction of the pipe 20 is relatively small, the sizing work to be conducted in the first step may be omitted, and the pipes 20, 21 may be connected with the connector 16 in the other step. Therefore, an end face position of the piping may be substantially adjusted only by the second step.

Figure 10:
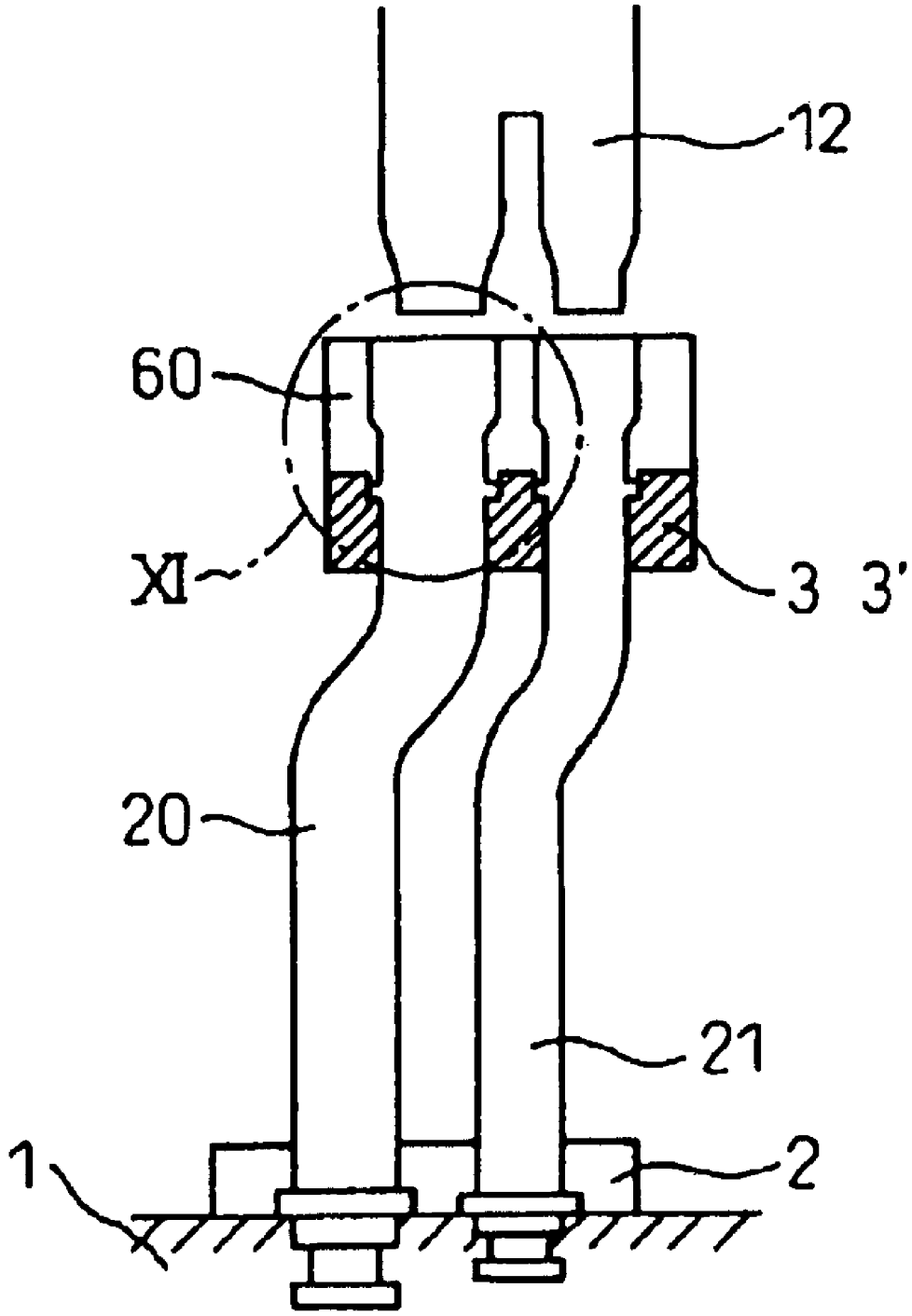
FIG. 10 is a conceptual view showing a punch and others for simultaneously machining two pipes.
Figure 11:
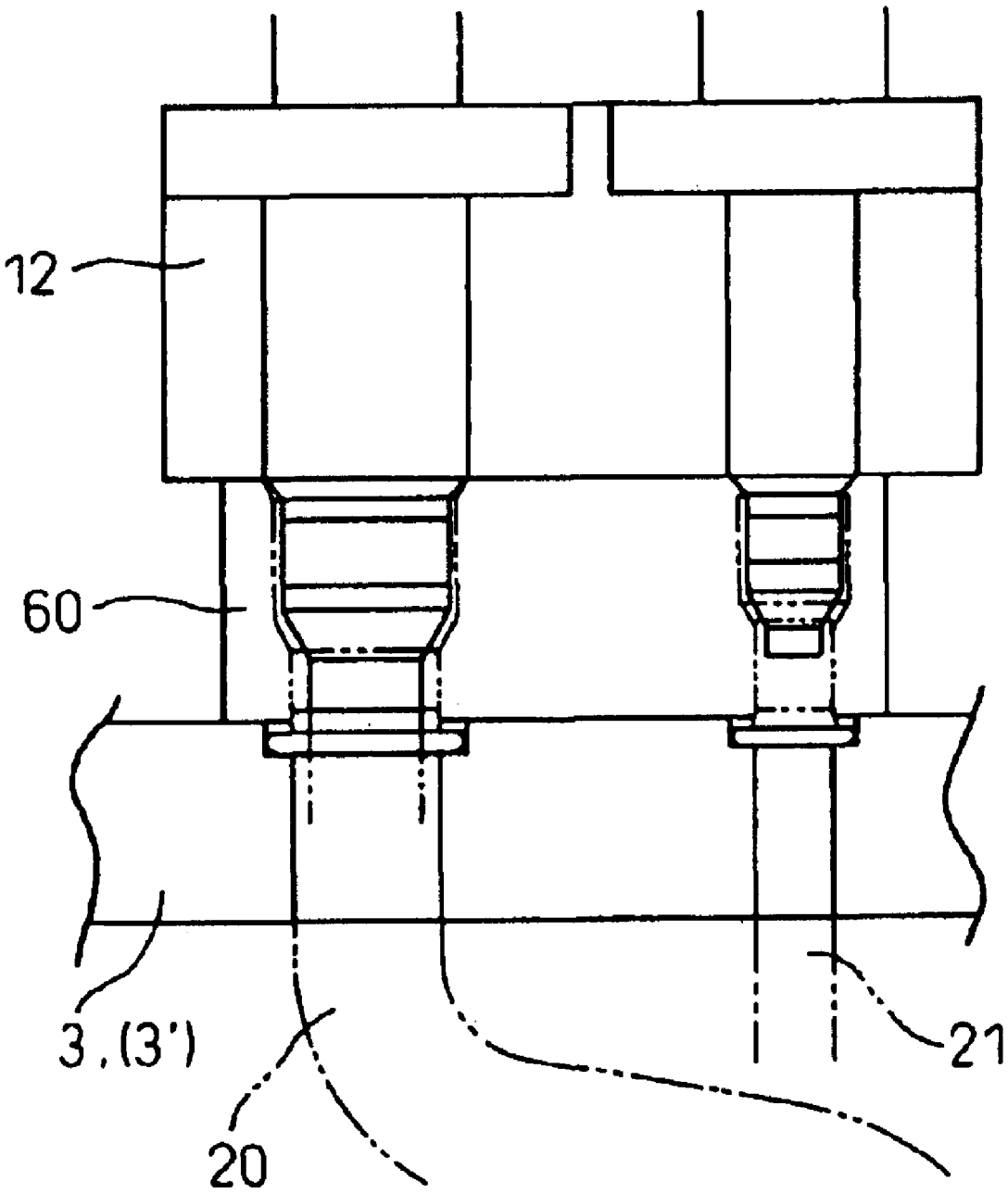
FIG. 11 is an enlarged sectional view showing a portion of FIG. 10.

In the case where the second step of the first embodiment is simultaneously executed for a plurality of pipes 20, 21, like the variation shown in FIG. 10 and FIG. 11 which is a partially enlarged view of FIG. 10, the aggregated punch 12 for expanding the diameter, in which two punches to be inserted into the pipes 20, 21 are integrated into one body, may be used. In this case, the connector 60 is provided with two conical opening portions according to the aggregated punch 12 for expanding the diameter. However, the other points are the same as those of the case described before. Therefore, the detailed explanations are omitted here.

In the first embodiment explained above, the lower connector 16 is caulked to the pipes 20, 21 at the end of the step, that is, the lower connector 16 is caulked to the pipes 20, 21 at the end of the first step or after the second step has been completed. In the same manner as that of the temporary pipe-fixing jig 2 used for temporarily fixing the pipes 20, 21 in the process of machining, the plane shape of the connector 16 is an E-shape. Therefore, it is unnecessary to insert the pipes 20, 21 into the connector 16, that is, the connector 16 can be engaged with the pipes 20, 21 from the outside at any time in the first or the second step. Accordingly, the connector 16 is engaged with the pipes 20, 21 at an appropriate time in such a manner that the temporary pipe fixing jig 2 is replaced with the connector 16, and the pipes 20, 21 are partially caulked to the connector 16. Alternatively, the pipes 20, 21 are expanded from the inside at the portion of the connector 16 so that the diameters of the pipes 20, 21 can be increased. In this way, the pipes 20, 21 can be fixed to the connector 16.

Figure 21:
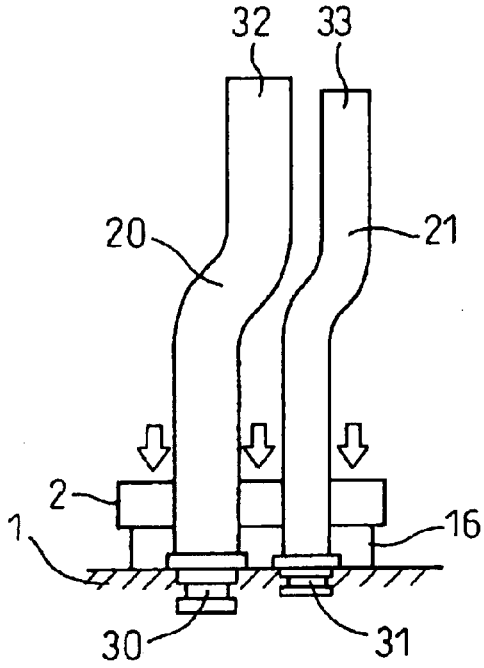
FIG. 21 is a conceptual view showing an example in which the order of the steps in the first embodiment is changed.

However, the lower connector 16 can be attached and caulked to one end portion of each of the pipes 20, 21 at the beginning of the first step. In this case, as shown in FIG. 21, the E-shaped connector 16 and the temporary fixing jig 2 are attached to the pipes 20, 21, one end portions of which are inserted into the pipe set jig 1, and a stroke is given to a portion of the connector 16 so that the connector 16 can be caulked to the pipes 20, 21. The temporary fixing jig 2 is detached at an appropriate time, for example, the temporary fixing jig 2 is detached after the completion of the second step.

Figure 22:
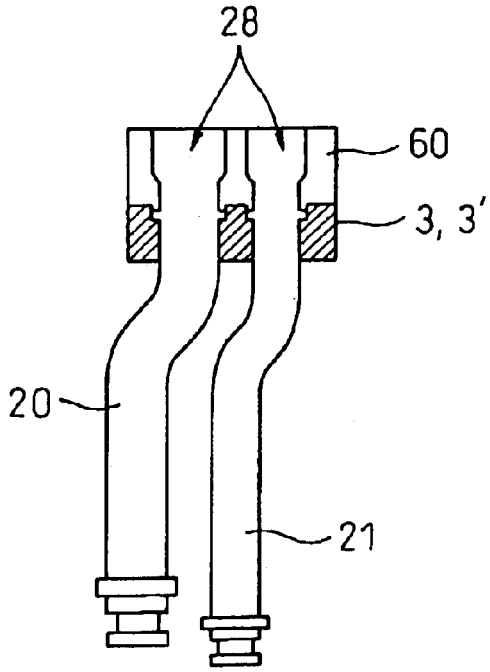
FIG. 22 is a conceptual view showing an example not including the first step of the first embodiment.

As a variation of the first embodiment, as described before, when the step in which the connector 16 is not attached to one end portions 30, 31 of the pipes 20, 21 is not executed but the other steps described before are executed, it is possible to manufacture piping, one end portions 30, 31 of which are free ends as shown in FIG. 22. In this case, the lengths of the pipes 20, 21 may be different from each other.

Next, referring to FIG. 12, the second embodiment of the method of manufacturing piping having a joining portion of the present invention will be explained as follows. The characteristic of the second embodiment is that a portion of the second step of the first embodiment is changed. Portions of the second step except for that and the first step of this embodiment can be handled in the same manner as that of the first embodiment. Depending upon the case, it is possible to omit the sizing work conducted in the first step.

Figure 12:
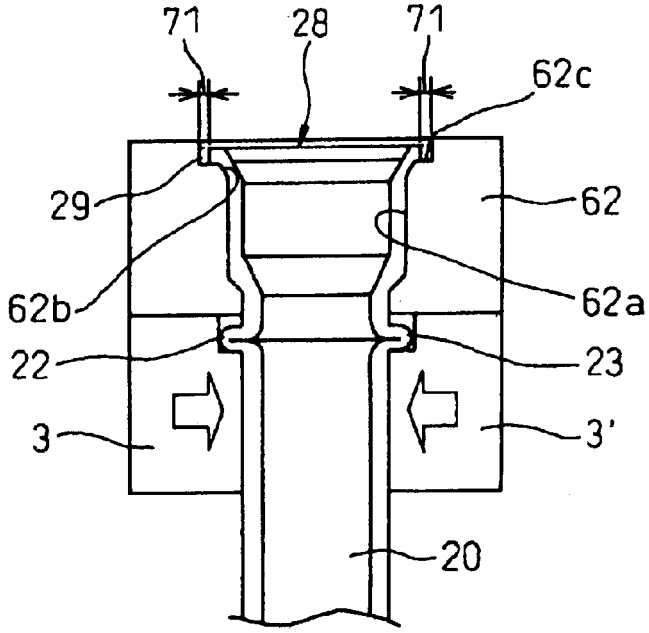
FIG. 12 is a sectional view showing a pipe fluctuation-absorbing portion in the second step of the second embodiment.

As can be understood when FIG. 12 showing the primary portion of the second embodiment is compared with FIG. 9, which corresponds to FIG. 12 and shows the primary portion of the first embodiment, the pipe fluctuation absorbing section 70 is provided in the connector 60 caulked to the pipes 20, 21 in the second step of the first embodiment, and this pipe fluctuation absorbing section 70 is arranged along a conical face of the conical opening portion 60*b* of the connector 60. On the other hand, in the second embodiment, the pipe fluctuation-absorbing section 71 is provided as follows. In the connector 62, the profile of which is substantially the same as that of the connector 60 of the first embodiment, the flat step portion 62*c* is formed on the forward end side of the conical opening portion 62*b* of the through-hole 62*a*, the diameter of which is expanded, and the pipe fluctuation absorbing section 71, which is a gap, is formed outside the step portion 62*c* in the radial direction, and further the diameter expanding portion 28 is formed with a punch for expanding the diameter not shown, the profile of which corresponds to the connector 62. Of course, the punch for expanding the diameter used in the second embodiment has a profile and function of forming the forward end portion of the pipe 20 into a flat shape so that it can be formed along the flat step portion 62*c* of the connector 62.

In the method of manufacturing piping having a joining portion of the second embodiment, the forward end portion 29 of the pipe 20 is curved along the flat step portion 62*c* of the connector 62 so that the pipe 20 can be positively engaged with the step portion 62*c*. In order to leave the pipe fluctuation absorbing portion 71, which is a relief space, in a portion ahead of the bent forward end portion 29, the lengths of the portions ahead of the buckling portions 22, 23 of the pipe 20 are previously restricted to a predetermined range. Due to the foregoing, in the same manner as that of the forward end portion 29 of the pipe 20 in which the pipe fluctuation absorbing portion 70 of the connector 60 is left in the first embodiment, the second embodiment has a function of adjusting the size of the piping in the longitudinal direction and an original function of positively caulking the connector 62 to the pipe 20.

Figure 13:
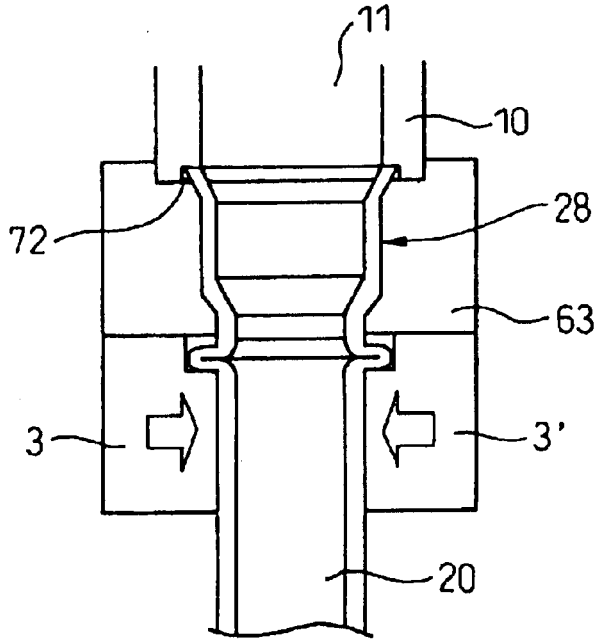
FIG. 13 is a sectional view showing a pipe fluctuation-absorbing portion in the second step of the third embodiment.

Next, referring to FIG. 13 and FIG. 14, which is a partially enlarged view of FIG. 13, the third embodiment of manufacturing a piping having a joining portion of the present invention will be explained. The characteristic of the third embodiment is that one portion of the second step of the first embodiment is changed. Therefore, portions of the other steps except for that and the first step can be handled in the same manner as that of the first embodiment. Depending upon the case, it is possible to omit the sizing work conducted in the first step. Alternatively, the connector 16 may be connected with the pipes 20, 21 in some other steps.

Figure 14:
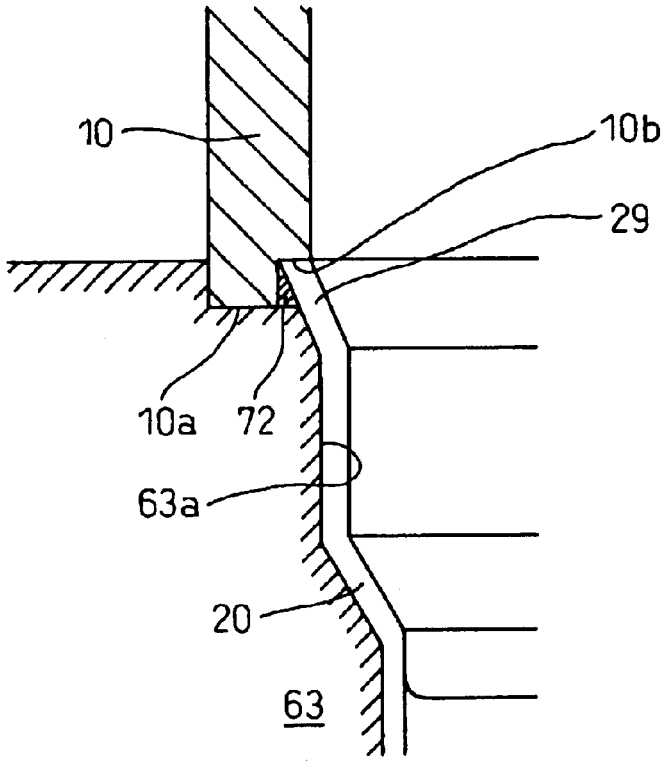
FIG. 14 is a partially enlarged view of FIG. 13.

The characteristic of the method of the third embodiment is that the fluctuation-absorbing portion 72 is formed in the connector 63 at the position shown in the enlarged view of FIG. 14. Different from the movable sleeve of the first embodiment, the movable sleeve 10 provided outside the punch 11 for expanding the diameter has an annular cutout portion 10*b*, the profile of which is step-like, formed on the inner face of a portion of the lower face 10*a*.

Accordingly, when the second step is executed in the third embodiment, first, the punch 11 for expanding the diameter is lowered, and the other end portion 32 of the pipe 20 is expanded. After that, the sleeve 10 is lowered and an edge portion of the forward end portion 29, which has been expanded, of the pipe 20 is crushed, and a portion of the material of the forward end portion 29 fills a portion of the fluctuation-absorbing portion 72. It is necessary for the fluctuation absorbing portion 72 to have some excess space. When the excess space is provided, in the same manner as that of the first and the second embodiment, it becomes possible to form the diameter expanding portion 28 at the end of the pipe 20 and positively caulk the connector 63, and it also becomes possible to adjust the size of the pipe 20 in the longitudinal direction. In this connection, after the completion of caulking, the diameter expanding punch 11 is raised first, and then the sleeve 10 is raised.

Next, referring to FIG. 15, the fourth embodiment of manufacturing a piping having a joining portion of the present invention will be explained. The characteristic of the fourth embodiment is that one portion of the second step of the first embodiment is changed. Therefore, portions of the other steps except for that and the first step can be handled in the same manner as that of the first embodiment. Depending upon a case, it is possible to omit the sizing work to be conducted in the first step, and it can be replaced with some other step for connecting the pipes 20, 21 with the connector 16. The characteristic of the manufacturing method of the fourth embodiment is that the fluctuation-absorbing portion is not provided in the end portion of the connector but is provided in the intermediate portion of the connector in the longitudinal direction.

Figure 15:
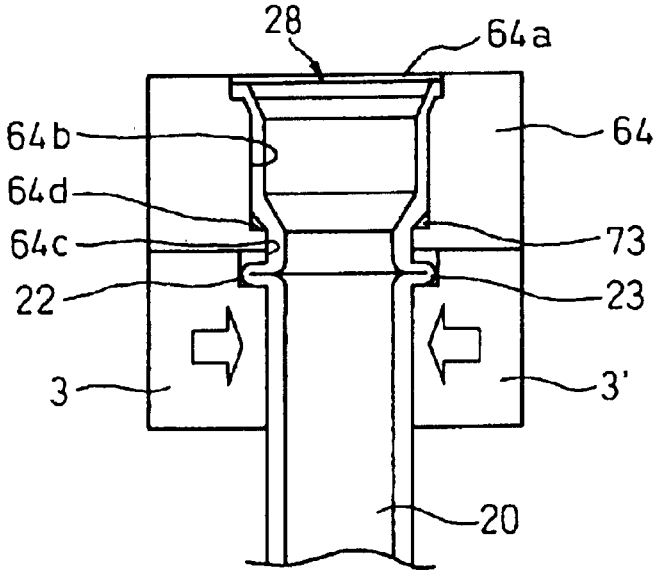
FIG. 15 is a sectional view showing a pipe fluctuation absorbing portion in the second step of the fourth embodiment.

As can be understood when FIG. 15, showing the primary portion of the second step of the fourth embodiment is compared with FIG. 9, which corresponds to FIG. 15 and shows the primary portion of the first embodiment, the pipe fluctuation absorbing section 70 is provided in the connector 60 in the second step of the first embodiment, and this pipe fluctuation absorbing section 70 is arranged along a conical face of the conical opening portion 60*b* of the connector 60. On the other hand, in the fourth embodiment, the pipe fluctuation-absorbing portion 73 is formed as follows. In the connector 64, the profile of which is substantially the same as that of the connector 60, the step portion 64*d* is formed between the large diameter portion 64*b*, which is in the through-hole 64*a* having an expanding shape, and the small diameter portion 64*c*. In a punch used for expanding the diameter not shown in the drawing, a conical face is formed in a portion corresponding to the step portion 64*d* of the connector 64 instead of the step portion. Due to the foregoing, the pipe fluctuation absorbing portion 73, which is a gap, is left in the step portion 64*d*.

Therefore, according to the method of manufacturing piping of the fourth embodiment, when a stroke is given by the diameter expanding punch not shown, the pipe 20 is machined along the through-hole 64*a*, the profile of which is to be expanded, and the diameter-expanding portion 28 is formed. Due to the foregoing, the pipe 20 is caulked to the connector 64. At this time, an excess material of the pipe 20 is smoothly pushed out into the fluctuation-absorbing portion 73, which is a relief space of the excess material, so that the size of the pipe 20 in the longitudinal direction can be reduced. In this way, the length of the pipe 20 can be made to agree with an appropriate value. Other points of the fourth embodiment are the same as those of the first embodiment.

Next, referring to FIGS. 16 and 17, the fifth embodiment of the method of manufacturing a piping having a joining portion of the present invention will be explained below. The second to the fourth embodiment described above correspond to variations of the second step of the first embodiment, however, the fifth embodiment corresponds to a variation of the first step of the first embodiment. Although the explanation of the second step of the fifth embodiment is omitted here, the second step of the fifth embodiment can be executed in the same manner as that of the second steps of the first to the fourth embodiment.

Figure 16:
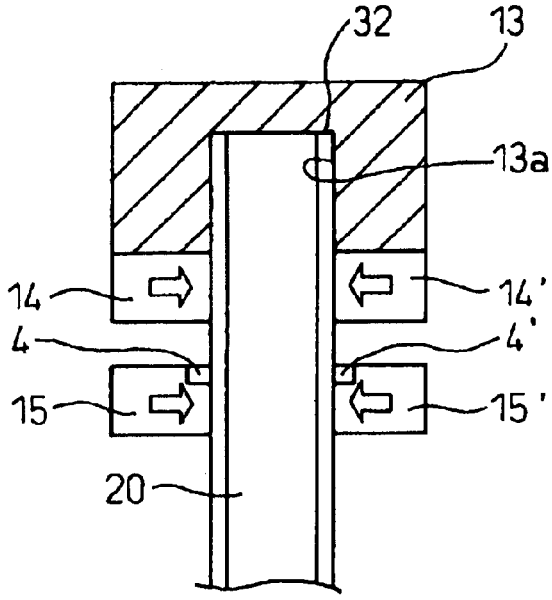
FIG. 16 is a sectional view showing a primary portion of the first step of the fifth embodiment.
Figure 17:
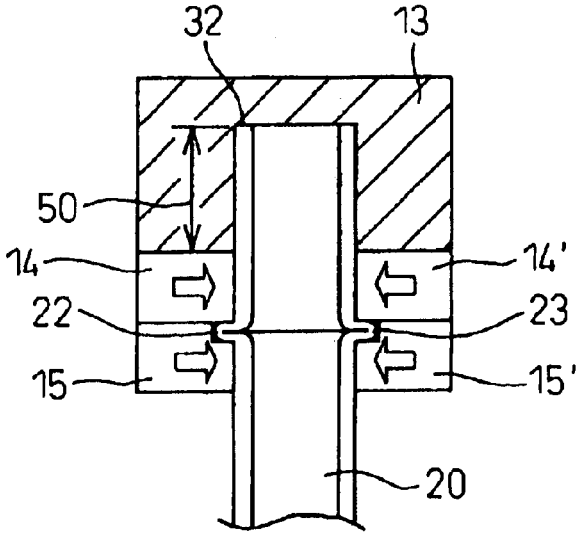
FIG. 17 is a sectional view showing a primary portion at the time successive to the time of the first step shown in FIG. 16.

As can be understood when FIGS. 16 and 17 showing the primary portion of the steps of the fifth embodiment are compared with FIGS. 4 and 5 corresponding to FIGS. 16 and 17 in the explanation of the first embodiment, instead of the pipe chucks 3, 3' used in the first embodiment, two sets of pipe chucks including the upper pipe chucks 14, 14' and the lower pipe chucks 15, 15' are used in the fifth embodiment. The semicircular step portions 4, 4', which are used as a relief space, are provided on upper faces of the lower pipe chucks 15, 15'. It is not necessary that the punch 13 for sizing is provided with the cylindrical recess portion 6*a* like the punch 6 for sizing of the first embodiment. In the fifth embodiment, only the cylindrical recess portion 13*a* may be provided.

In the case where the size of the pipe 20 in the longitudinal direction is adjusted because it is too long, as shown in FIG. 16, an intermediate portion of the pipe 20 is clamped by the upper chucks 14, 14' and the lower chucks 15, 15' while a necessary interval is being maintained between the upper and the lower chucks. This interval is set at a value corresponding to a difference between the actually measured length of the pipe 20 and the appropriate value. When the other end portion 32 of the pipe 20 and the upper pipe chucks 14, 14' are given a stroke by the punch 13 for sizing, the upper pipe chucks 14, 14' are lowered to a position where the upper chucks 14, 14' come into contact with the lower chucks 15, 15'. Therefore, a portion of the pipe 20 between the two sets of pipe chucks is buckled, and the material of the buckled portion flows into the semicircular step portions 4, 4' provided in the lower pipe chucks 15, 15' as a relief space, and the flange-shaped pipe buckling portions 22, 23 can be formed. The operation and effect of this flange portion is the same as that in the first step of the first embodiment. In this way, the length of the pipe 20 can be made to agree with the appropriate value.

Figure 23:
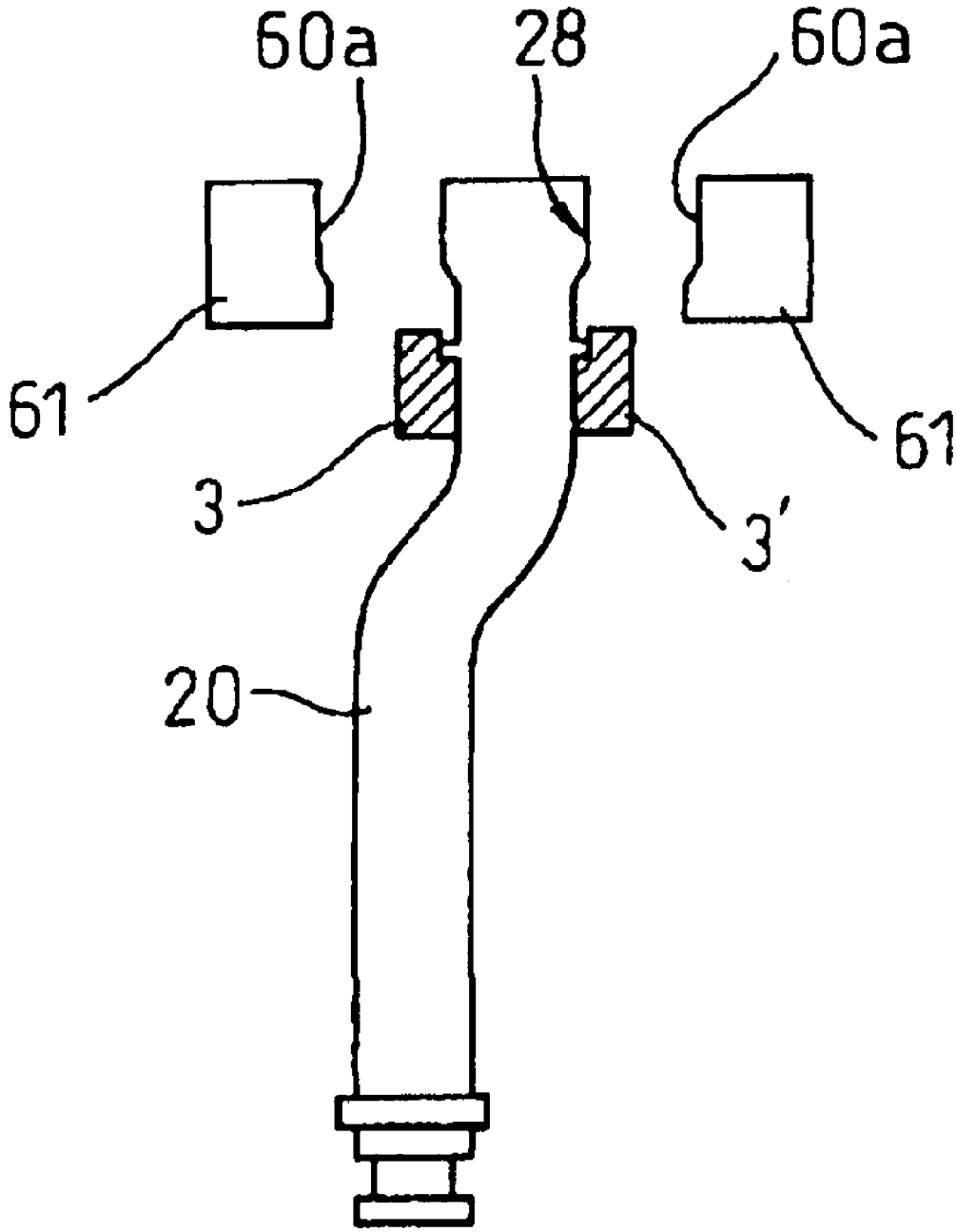
FIG. 23 is a conceptual view showing an example of a pipe not having a connector.

In the above explanations, the following case is shown as an example. When at least one end portion of a piping having a joining portion is caulked to the inner face of a connector such as a connector 60 having a through-hole to be expanded, a joining portion is formed. At the same time, the diameter-expanding portion 28 for automatically adjusting the lengths of the pipes 20, 21 is formed. An object of the method of manufacturing a piping having a joining portion of the present invention is to manufacture a piping in which the diameter expanding portion 28 as a joining portion is formed at one end portion of a pipe. Therefore, in the case where the diameter expanding portion 28 formed as a joining portion can be connected with a portion of an opponent without using a connector, it is unnecessary for a complete product to have the connector. Accordingly, for example, as shown in FIG. 23, in the case where a piping, the end portion of the pipe 20 of which is a diameter expanding portion 28 without a connector, is manufactured, the female type jig 61, which is a split type metallic die, having the same inner face profile as that of the through-hole 60*a* of the connector 60 to be expanded, is used, and the expanding diameter portion 28 is formed and the length of the pipe 20 is adjusted at the same time. After that, the female type jig 61 is opened.

In this connection, a method, in which a pipe and a connector are connected with each other by means of caulking, and not brazing, in the same manner as that of the present invention, has been conventionally attempted until now. The conventional method of manufacturing a piping having a joining portion and problems caused in the conventional method will be briefly explained referring to FIGS. 18 to 20 as follows.

Figure 18:
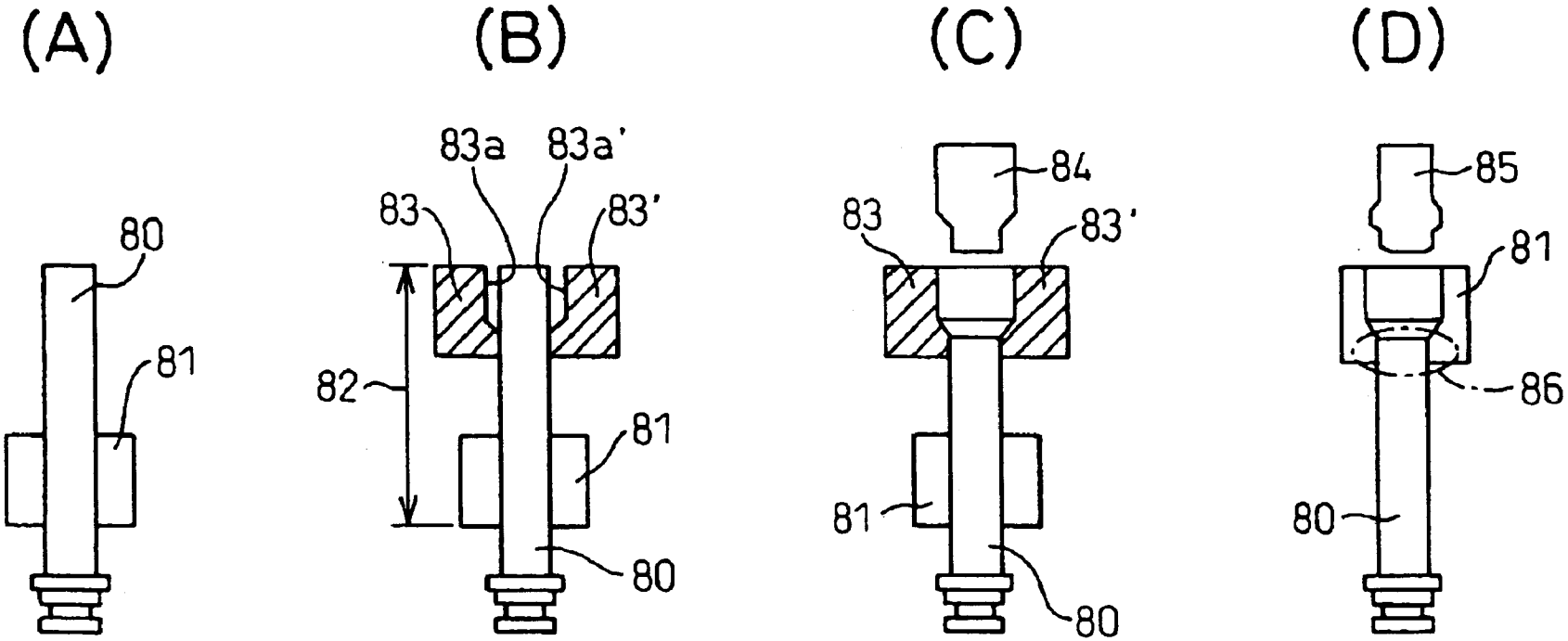
Fig.18 PRIOR ART
FIG. 18 is a process drawing showing a conventional method of manufacturing a piping having a joining portion.

One of the methods of manufacturing a piping having a joining portion by the prior art is shown in FIG. 18. This conventional method is executed as follows. With the pipe 80, at one end of which a flange and groove are previously formed by means of bulging and spinning, the connector 81 is engaged in step (A). This connector 81 is moved to a position as distant as possible so that it cannot get in the way. However, a range in which the connector 81 can be moved is limited to a straight portion of the pipe 80. Therefore, the movable range is indicated by the reference numeral 82 in the view showing the step (B). In the step (B), a predetermined position of the pipe 80 is clamped by the split jigs 83, 83' that can be split into two pieces. In the jigs 83, 83', the inner faces 83*a*, 83*a'*, which are joined to each other and formed into a profile open upward, are formed.

In the step (C), the other end portion of the pipe 80 is machined by the diameter expanding punch 84, the surface profile of which is similar to the profiles of the inner faces 83*a*, 83*a'* of the jigs and smaller than the profiles of the inner faces 83*a*, 83*a'* of the jigs by the wall thickness to be left between the jigs and the punch. At this time, the jigs 83, 83' support a portion of the pipe 80 to be machined and function as a metallic die used for forming. Therefore, the other end portion of the pipe 80 is formed into a profile open upward. To the other end portion of the pipe 80 formed in this way, the jigs 83, 83' are moved by being opened. After that, the connector 81 is moved and engaged. Therefore, a profile open upward is formed on the inner face of the connector 81.

After the engagement, the caulking punch 85 is inserted into the other end portion of the pipe 80 so that one portion 86 of the pipe 80 is expanded. Due to the foregoing, the pipe 80 and the connector 81 are caulked to each other. However, a joining portion between them is only the straight pipe portion 86, which has been expanded. Therefore, the mechanical strength and the sealing performance of the joining portion are not sufficiently high. Since the step is complicated, the manufacturing cost is high. Further, in order to move the connector 81, it is necessary to provide a long straight pipe portion in the pipe 80. It is possible to take consideration into a method in which the above step is executed under the condition that the pipe 80 is straight and then the pipe 80 is bent into a required shape in the later process. However, according to this method, it is difficult to conduct bending. Further, there is provided no means for adjusting the length of the pipe 80. Accordingly, it is impossible to manufacture a piping with high accuracy.

Figure 19:
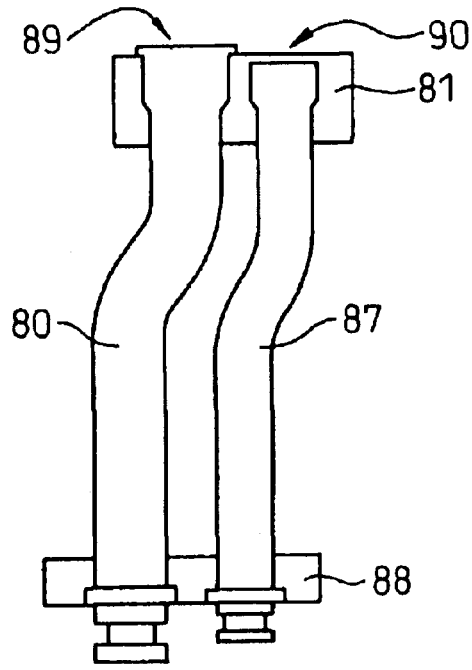
Fig.19 PRIOR ART
FIG. 19 is a conceptual view showing problems caused in the prior art.

Therefore, according to the conventional method, it is necessary to enhance the accuracy of the size and bent profile of the pipe 80 before the pipe is connected with the connector 81. As shown in FIG. 19, in the case where the connectors 81, 88 are attached to both end portions of the two pipes 80, 87 so as to manufacture piping, when the pipe 80, which is much longer than an appropriate value, and the pipe 87, which is much shorter than an appropriate value, are aligned at one end portion and fixed to the connector 88, since both pipes 80, 87 are bent, positions of the other end portions of the pipes 80, 87 fluctuate three-dimensionally. Therefore, it is very difficult to connect them with the connector 81 at predetermined positions. The forward end portion 89 of the pipe 80 protrudes from the connector 81 even by the fluctuation of the length in the longitudinal direction. Further, as the forward end portion 90 of the pipe 87 does not come to a predetermined position, both pipes 80, 87 are incompletely caulked to the connector 81.

Figure 20:
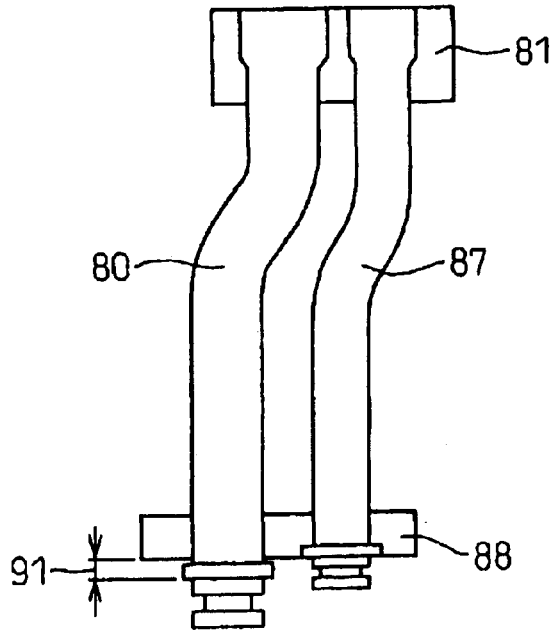
Fig.20 PRIOR ART
FIG. 20 is a conceptual view showing other problems caused in the prior art.

Therefore, as shown in FIG. 20, when the forward end portions of the pipes 80, 87 are aligned at predetermined positions of the connector 81 and expanding and caulking of this portion are conducted being ahead of expanding and caulking of the other portions, the lower end portions of the pipes 80, 87 cannot be aligned in the connector 88.

Therefore, as indicated by the reference numeral 91, the end faces of the pipes are shifted from the surface of the connector 88. For the above reasons, it is impossible to accomplish a good caulking of the pipes with the connector 88.

Various problems of the conventional method of manufacturing a piping having a joining portion described above can be solved by the manufacturing method of the present invention, and it is possible to easily manufacture piping, the dimensional accuracy of which is high, by a relatively simple manufacturing apparatus at a low manufacturing cost.

What is claimed is:

1. A method of manufacturing piping having a respective joining portion at both end portions of a pipe in which a diameter expanding portion is formed at an end portion of a pipe, comprising the steps of:

a first step of adjusting the pipe length necessary to form the diameter expanding portion before forming the diameter expanding portion, a second step of absorbing an excessive pipe material which is not allowed to adjust the pipe length when forming the diameter expanding portion, wherein the diameter expanding portion is formed in a predetermined shape by means of adjusting the volume of material at the forming end of the pipe without occurring flashes and underfills (thin portions);

said first step including:

a step of positioning one end of the pipe by a jig, the pipe being formed in an excessive length capable of absorbing the fluctuation of the pipe length, a step of fixing the pipe by clamping the pipe at a position apart from the one end of the pipe, which is positioned by the jig, in a determined distance defined by a product size by a pipe chuck, and a step of adjusting the pipe length by adjusting a size of an annular protruding portion formed on an outer circumference of the pipe, and said annular protruding portion being formed by pressing the end of the pipe in the fixing side with a punch used for sizing, buckling the pipe and pushing out a portion of the pipe into a relief space previously formed on an end face of said pipe chuck, and said second step including the steps of:

a step of inserting the other end portion of the pipe into a connector having a through-hole, the inner diameter of which is expanded, and a step of caulking the other end portion of the pipe with a diameter expanding tool so as to expand the diameter of the other end portion thereof and caulk the other end portion of the pipe to the inner face of said connector, wherein, as a pipe length fluctuation absorbing portion is previously formed in a portion of the inner face of said connector, when a plastic deformation is given to the other end portion of the pipe by said diameter expanding tool so as to form the diameter expanding portion, the excessive pipe material is absorbed by the pipe length fluctuation absorbing portion of said connector and the pipe length is adjusted and automatically conformed to a predetermined length.

2. A method of manufacturing piping according to claim 1, wherein a quantity of reduction of the pipe length is increased when a radius of the protruding portion is increased.

3. A method of manufacturing piping according to claim 2, wherein the relief space formed on the end face of the pipe chuck has a constant depth from the end face of the pipe chuck.

4. A method of manufacturing piping according to claim 1, wherein after an end portion of the pipe on the side opposite to the side on which the diameter expanding portion is formed has been fixed at a predetermined position by a jig, when a portion of the pipe is clamped and fixed by the pipe chuck, the length of the pipe from the end face of the pipe chuck is adjusted.

5. A method of manufacturing piping according to claim 1, wherein the pipe length fluctuation absorbing portion formed inside the connector is formed in a gap between the inner face of the through-hole of the connector and the surface of the diameter expanding tool.

6. A method of manufacturing piping according to claim 5, wherein the pipe length fluctuation absorbing portion is formed corresponding to an end portion of the pipe located inside the connector.

7. A method of manufacturing piping according to claim 5, wherein the pipe length fluctuation absorbing portion is formed corresponding to an intermediate portion of the pipe located inside the connector.

8. A method of manufacturing piping according to claim 1, wherein the connector is a female type jig capable of being split having the through-hole, the inner face of which is expanded, is used so that the end portion of the pipe is expanded and caulked to the inner face of the female type jig, and then the female type jig is opened.

* * * * *